United States Patent [19]

Haugsjaa et al.

[11] 3,942,058

[45] Mar. 2, 1976

[54] ELECTRODELESS LIGHT SOURCE HAVING IMPROVED ARC SHAPING CAPABILITY

[75] Inventors: Paul Osborne Haugsjaa, Acton; William F. Nelson, Weston; Robert James Regan, Needham; William Henry McNeill, Carlisle, all of Mass.

[73] Assignee: GTE Laboratories Incorporated, Waltham, Mass.

[22] Filed: Apr. 21, 1975

[21] Appl. No.: 570,070

[52] U.S. Cl. ..... 313/44; 315/39; 315/248

[51] Int. Cl.[2] ..... H01J 61/52

[58] Field of Search ..... 313/44, 182; 315/39, 248, 315/267, 344

[56] References Cited

UNITED STATES PATENTS 3,787,705 1/1974 Bolin et al. ..... 315/248

*Primary Examiner*—R. V. Rolinec
*Assistant Examiner*—Darwin R. Hostetter
*Attorney, Agent, or Firm*—Irving M. Kriegsman; Leslie J. Hart

[57] ABSTRACT

An electrodeless lamp is positioned at the end of an inner and outer conductor forming a termination fixture, the inner conductor being shaped such that the arc within the lamp during excitation is isolated from the wall of the lamp envelope. The inner conductor may be formed as a hollow helical element thereby providing both an axial and azimuthal electric field component. Alternatively, the inner conductor may be cup-shaped which has a shielding effect to control the electric field strength at the end of the conductor. The helical or cup element and other features of the inner conductor provide both arc shaping and impedance matching between the complex impedance of the lamp during operation and the output impedance of a high frequency power source which is coupled to the termination fixture.

7 Claims, 12 Drawing Figures

ELECTRODELESS LIGHT SOURCE HAVING IMPROVED ARC SHAPING CAPABILITY

BACKGROUND OF THE INVENTION

The present invention relates to electrodeless light sources and, more particularly, to such sources which are excited by high frequency power, such as in the range of 100 MHz to 300 GHz.

There have been, historically, three basic methods of exciting discharges without electrodes. The first method uses the discharge as a lossy part of either the capacitance or inductance of a "tank" circuit. This method is used to advantage only at frequencies where the dimensions of the lamp are much smaller than the wavelength of excitation. Also, in this method, there are power losses due to radiation and shifts in frequency upon start-up. A second method of exciting electrodeless lamps with microwave power is to place the lamp in the path of radiation from a directional antenna. However, since free propagation of microwave power occurs, there is an inherent inefficiency and some of the power is scattered, thereby endangering persons in the area.

A third method uses a resonant cavity which contains the lamp, a frequency tuning stub and a device for matching the lamp-cavity impedance to that of the source and transmission line. Examples of devices according to this method may be found in "Microwave Discharge Cavities Operation at 2450 MHz" by F. C. Fehsenfield et al., Review of Scientific Instruments, Volume 36, Number 3 (March, 1965). This publication describes several types of tunable cavities. In one type, cavity No. 5, the discharge cavity transfers power from the source to the lamp, and the resonant structure of the cavity increases the electric field in the gas of the lamp. The presence of a discharge in the resonator changes the resonant frequency and also changes the loaded Q factor. Therefore, it is necessary to provide both the tuning (frequency) and matching (inapedance) adjustments to obtain efficient operation over a wide range of discharge conditions. The tuning stub is first adjusted for a minimum reflected power with the minimum probe penetration. Next, the probe (impedance) is adjusted. Since these two operations are not independent, successive readjustments are required to achieve optimum efficiency.

All of these tunable cavities have features which make them less than ideally suited for use in an electrodeless light source. To make cavity type systems useful economically, the cavity must be small enough so that it would be feasible to use such systems in place of the conventional electrode containing lamp. Resonant cavities are too large and must be larger if lower microwave frequencies are used. One resonant cavity for 2450 MHz operation has four inches as its greatest dimension; the size would be even larger for operation at 915 MHz which is a standard microwave frequency for consumer use, such as with microwave ovens. Operation at this lower frequency is also advantageous from the view that the greater the frequency, the more expensive the microwave power source becomes. The known tunable cavity has a less than optimum shape because the lamp is substantially enclosed by the resonant cavity housing, thereby impeding the transmission of light.

SUMMARY OF THE INVENTION

It is an object of the present invention to provide an improved light source utilizing an electrodeless lamp.

It is another object of the present invention to provide a termination fixture for an electrodeless lamp in which the shape of the arc in the electrodeless lamp may be controlled such that the arc remains isolated from the wall of the electrodeless lamp envelope.

It is still another object of the present invention to provide a method of exciting an electrodeless lamp by which the arc is detached from the envelope, thereby enhancing the life of the lamp.

According to the present invention, an improved light source includes a source of power at a high frequency, an electrodeless lamp having an envelope made of a light transmitting substance and a volatile fill material enclosed within the envelope, the fill material emitting light upon breakdown and excitation, a termination fixture having an inner conductor and an outer conductor, the conductors having a first end which couples power to the lamp and a second end which is coupled to the source and means operatively associated with the fixture for shaping the arc within the lamp during excitation so that the arc does not attach to the interior wall of the envelope, thereby enhancing the life of the electrodeless lamp. It has been found that the arc may be isolated from a particular area by adjusting the detailed power balance for that area; the power equation is $P_e - P_h = P_r$, where $P_e$ is the power gained electrically, $P_r$ is the power radiated and $P_h$ is the power lost as heat. More specifically, it has been found that an arc exists where $P_e$ is greater than $P_h$; thus, the arc shaping means includes means for controlling the power balance such that the power gained electrically $P_e$ is less than the power lost as heat $P_h$. The magnitude of $P_e$ is determined by the equation $P_e = n_e \mu E^2$, where $n_e$ is the electron density, $\mu$ is the electron mobility and E is the electric field strength. Preferably, the power controlling means includes means for limiting the magnitude of the electric field strength thereby limiting the power gained electrically so that this power $P_e$ is less than $P_h$ in the region adjacent to the envelope.

According to the invention, an improved method of producing light includes placing the electrodeless lamp at the ends of the conductors of the termination fixture, applying power at a high frequency to the other ends of the conductor to excite the lamp fill material and thereby to produce an arc and shaping the arc so that it does not attach to the lamp to enhance the life of the lamp. Preferably, the arc shaping is obtained by controlling the power balance such that $P_h$ is equal or greater than $P_e$. In the preferred method, the power is controlled by limiting the magnitude of the electric field strength in the region near the envelope. The presently preferred method of field limiting is obtained by shaping the geometry of the end of the inner conductor which is in the contact with the lamp.

GENERAL OPERATIONAL DESCRIPTION

Figure 9:
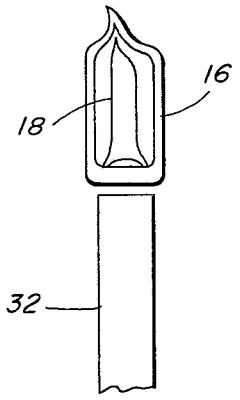
FIG. 9 is a diagram showing the creation of an arc which attached to the envelope wall for a straight ended fixture inner conductor.

Electrodeless lamps have the potential for extremely long life, because there is no need for the arc discharge to be in contact with any material, either electrodes (i.e, since there are none) or the lamp envelope. However, there is a tendency in the operation of high pressure electrodeless lamps in termination fixtures for the arc to be in close contact with the envelope walls, thereby causing damage to the wall and foreshortening the lamp's lifetime. Typically, this attachment of the arc to the wall of the lamp occurs at the point where the lamp is in contact with the center conductor of the fixture, where the electric field intensity is high. The arc exhibits many footed, root-like extensions of the main arc to the wall. The attaching members terminate at hot spots on the envelope surface. This problem is illustrated in FIG. 9 of the drawings. It is believed that the existence of the attachment members is due to the high rate of microwave energy absorption by them and the inability of the plasma in the vicinity of the wall to dissipate this energy and lower its temperature by either radiative or convective processes. Hence, it conducts the excess energy to the wall and does damage.

The purpose of this invention is to provide an electrode-less arc discharge in which the arc is sufficiently isolated from the wall of the lamp envelope so that no damage to the wall occurs over a long period of time. An arc may be isolated from a particular area by adjusting the detailed power balance for that area. This involves the equation $P_e - P_h = P_r$, where $P_e$ is the power gained electrically, $P_r$ is the power radiated and $P_h$ is the power lost as heat.

Figure 1:
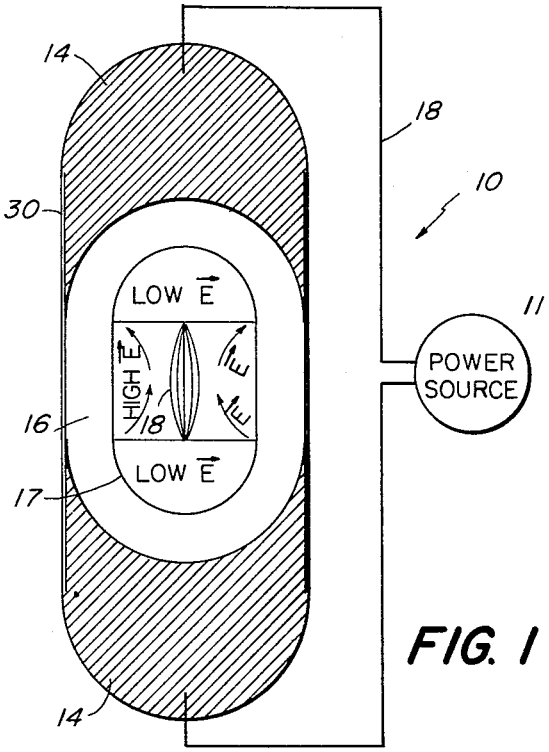
FIG. 1 is a diagram illustrating the principle of field shaping according to the present invention.

Generally, an arc exists in a region where $P_e > P_h$. This invention relates to a way in which $P_e$ can be made small enough in a region so as not to allow an arc to exist there. $P_e = n_e \mu E^2$, where $n_e$ is the electron density, $\mu$ the electron mobility and $E$ the electric field strength. In a fixture such as the termination fixture described herein, it is possible to adjust the field strength E by one of several techniques. These techniques include adjusting the position of fixture conductors, shaping the center conductor or field coupling probe, adjusting the position and shape of lossless magnetic or dielectric material within the fixture, adjusting the shape of the exterior walls of the fixture, adjusting the configuration, position and material of the lamp envelope, and controlling the current paths on the exterior fixture walls by use of a pattern of conductors. Therefore, by using one or several of these techniques, one may reduce the field strength near the lamp wall, and thus the arc can be isolated from the walls. With arc isolation from the envelope wall, the lifetime is increased several orders of magnitude. This concept is shown schematically in FIG. 1 of the drawings which shows an improved light source 10. In FIG. 1, high frequency power from a source 11 is applied to a termination fixture 30 which includes herein an arc shaping means 14 and an electrodeless lamp 16. By a suitable arc shaping means 14, the electrid field electric the electrodeless lamp envelope 17 can be maintained sufficiently low such that an arc 18 is located in a manner isolated from the lamp envelope.

The presently preferred way of arc shaping is by appropriately shaping the geometry of the end of the inner conductor. In one preferred embodiment, the inner conductor of the termination fixture is shaped in the form of a helix. A helical center conductor allows use of a shorter termination fixture than a quarter wavelength; it allows for control over the field shape so that, the arc can be isolated from the envelope and, finally, it provides a means for impedance matching the lamp to the input.

A helical line inside a conducting cylinder constitutes a slow wave structure; if $\Psi$ is the pitch angle, such that $\cot \Psi = 2\pi a/p$, where $a$ is the helix radius and $p$ is the pitch, then the wave propagation velocity is $v = c \sin \Psi$. Thus, the phase velocity is always less than the velocity of light. The wavelength along the helix is reduced, $\lambda_H = \lambda_O \sin \Psi$. Hence, a quarter-wave termination fixture can be reduced in length by the factor $\sin \Psi$.

Wave propagation on a helix is, in general, complex. However, much of the observed behavior of arcs in helices can be understood in terms of the dominant mode. This mode has a field pattern with an electric field component $E_Z$ in axial direction, and also a field $E_\Phi$ in the azimuthal direction. Thus, in FIG. 2 a lamp placed in the region I ($R_I$) inside the helix might have either an axial arc or a toroidal (donut shaped) arc lying the horizontal plane. The ratio of the fields in controlled by the helix parameters; $E_Z/E_\Phi = (a/r) \cot \Psi$. A lamp placed just above the helix in region II ($R_{II}$) would be excited in the axial direction.

Figure 7:
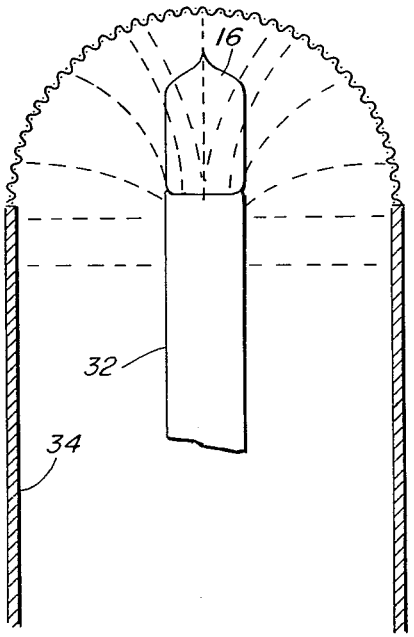
FIG. 7 is a diagram illustrating the field pattern for a straight-ended, fixture inner conductor.
Figure 8:
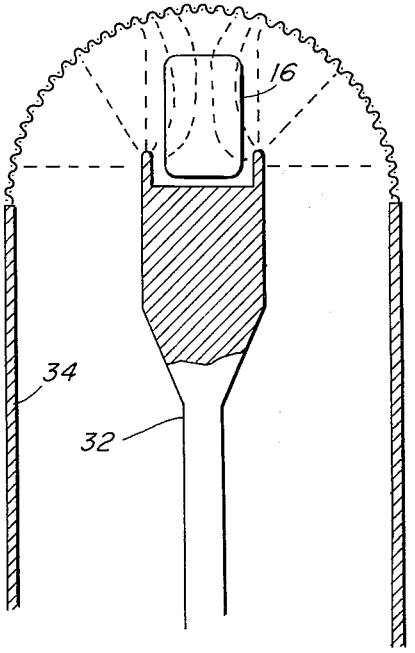
FIG. 8 is a diagram illustrating quasi static field lines for a fixture utilizing a cup member according to the present invention.

In another embodiment the inner conductor is shaped in the form of a cup. This design of the inner conductor is based on a quasi-static approximation, i.e., the field configuration is that one would calculate based on a static analysis, e.g., Laplaces equation with boundary conditions, even though the field is in fact oscillating at high frequency. The basic idea for reducing fields and arc attachment with the cup arrangement is illustrated in FIGS. 7 and 8. A straight termination as in FIG. 7 of the inner conductor at the lamp leads to a high field concentration at the base of the lamp. The dotted lines represent approximate electric field line contours as would be obtained for a static field with a potential difference between the center conductor and the outer conductor. FIG. 8 illustrates the shielding effect of a cup into which the lamp is placed, thereby reducing the electric field intensity at the base of the lamp.

It has been found that the impedance of the lamp during operation is complex and that the reactive component, usually capacitive, is usually greater than the real component. The termination fixture of the present invention, in addition to providing arc shaping capability, also matches the reactive impedance of the lamp to the output impedance of the high frequency power source. Combined arc shaping and impedance matching is obtained by a helical center conductor and/or a cup member and a multi-section center conductor in which the sections have a different characteristic impedance.

DESCRIPTION OF THE PREFERRED EMBODIMENTS

Figure 2:
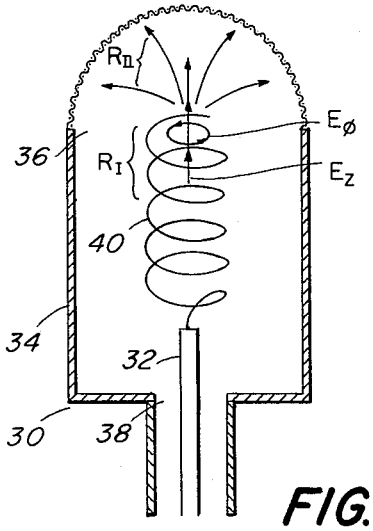
FIG. 2 is a diagram illustrating a preferred field shaping technique in which a toroidal arc may be obtained.

In an exemplary embodiment of the present invention, as shown in FIGS. 1 and 2, a light source, indicated by the reference numeral 10, includes a source 11 of power at a high frequency, an electrodeless lamp 16 and a termination fixture 30 coupled to the source, such as by a transmission cable 18. As used herein, the phrase "high frequency" is intended to include frequencies in the range generally from 100 MHz to 300 GHz. Preferably, the frequency is in the ISM band (i.e., industrial, scientific, and medical band) which ranges from 902 MHz to 928 MHz. A particularly preferred frequency is 915 MHz. One of many commercially available power sources which may be used is an Airborne Instruments Laboratory Power Signal Source, type 125. The lamp 16 has an envelope 17 made of a light transmitting substance, such as quartz. The envelope encloses a volatile fill material which produces a light emitting discharge upon excitation. Several known fill materials may be used, which produce a high pressure discharge.

Figure 3:
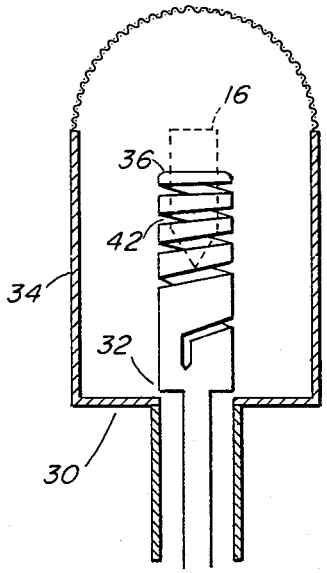
FIG. 3 is a partial sectional view of a fixture having a helical center conductor.

In FIG. 2, a termination fixture 30 includes an inner conductor 32 and an outer conductor 34. As shown herein, the outer conductor 34 is disposed around the inner conductor 32. The conductors have a first end 36 which is adapted to couple power to the lamp to produce excitation and a second end 38 adapted to be coupled to the source. The fixture 30 includes, as the arc shaping means 14 of FIG. 1, a coil 40. The coil 40 produces an electric field in the region of the lamp having a component along and a component around the longitudinal axis of the inner conductor 32. Referring now to FIG. 3, the coil comprises an inner conductor 32 whose first end 36 is hollow and circular in cross section and formed with a uniform slot 42 along the periphery thereof to produce a helical conductor. Preferably, the pitch of the slot 42 is variable to create a strong axial field in a region within the inner conductor and to compensate for at least a part of the reactive impedance of the lamp during excitation. Several lamps were run using this center conductor in a termination fixture. Axial arcs, toroidal arcs, and discharges apparently excited by both axial and azimuthal fields are obtainable. In particular, a lamp filled with mercury, sodium iodide, scandium iodide and argon and having a cylindrical envelope was run axially; the arc was observed to isolate from both ends of the envelope when the lamp was appropriately placed just inside the helix in region $R_I$. Small mercury lamps in both cylindrical and spherical envelopes, have been run with isolated torodial discharges, excited by the azimuthal field inside the helix. Finally, a metal halide lamp in a spherical envelope run inside the helix was apparently coupled to both components of the dominant helical mode. The discharge is quite diffuse and detached from the lamp wall.

Figure 4:
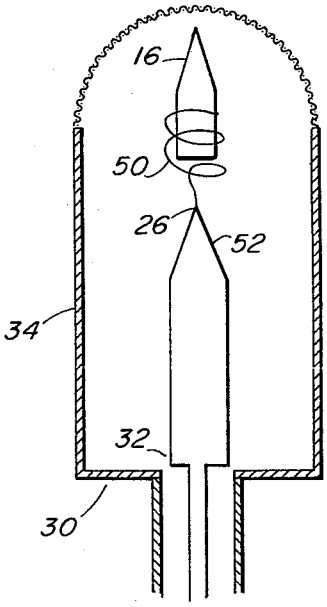
FIG. 4 is a partial sectional view of a fixture having a coil between the lamp and inner conductor.

Referring now to FIG. 4, the means for producing a two component field includes a coil 50 connected to the first end 26 of the inner conductor 32. Preferably, the inner conductor 32 is tapered as illustrated at 52. Also, the coil 50 preferably has about 3 turns. Since this method of matching the inner conductor to the coil does not establish as strong a dominant helical mode in the coil as in the embodiment of FIG. 2, the behavior is different. In particular the axial field is less but the azimuthal field is strong because of the low number of turns in the coil. With this coil, small mercury lamps with spherical and cylindrical wall envelopes ran with torodial discharges. However, the axial field is so weak inside the coil that when a cylindrical metal halide lamp was run with an axial arc, the arc would not penetrate into the coil even if the envelope were lowered well into the coil. In fact, arc isolation was achieved simply by placing the lamp partly into the coil. The arc was observed to be completely detached from the top and bottom.

Figure 10:
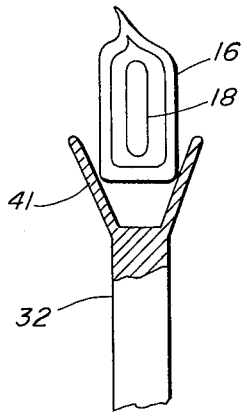
FIG. 10 is an elevational view of a flared inner conductor according to the present invention.
Figure 11:
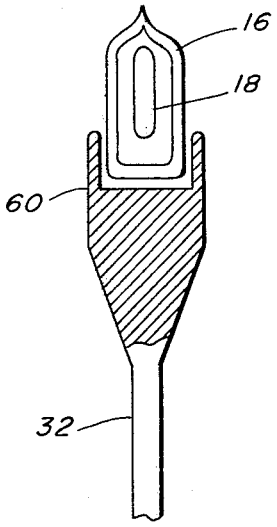
FIG. 11 is an elevational view of a cup shaped inner conductor according to the present invention.
Figure 12:
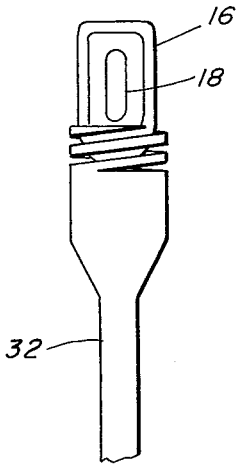
FIG. 12 is an elevational view of a helical inner conductor according to the present invention.

Referring now to FIGS. 10 and 11 there is shown two embodiments for an arc shaping device in which the end of the inner conductor is shaped to provide a shielding effect. In FIG. 10 the inner conductor 32 is flared to form a cup-shaped arrangement 41 with the lamp being located within the cup. The lamp shown is a small cylindrical lamp of 16 mm length and 8 mm O.D., having metal halide additives in a high pressure mercury lamp. This arrangement was to isolate the arc in a flared center conductor, but isolation was quite sensitive to the position of the lamp. FIG. 11 illustrates a cup-shaped member 60 in which the sides of the cup are parallel to the inner conductor longitudinal axis.

Figure 5:
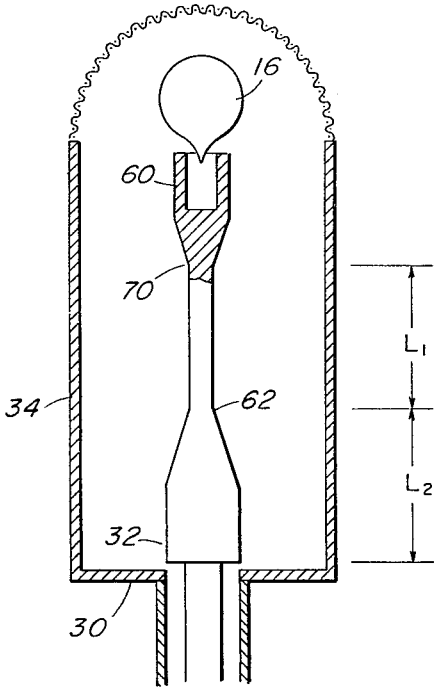
FIG. 5 is another embodiment of a fixture having a field shaping and impedance matching capability.
Figure 6:
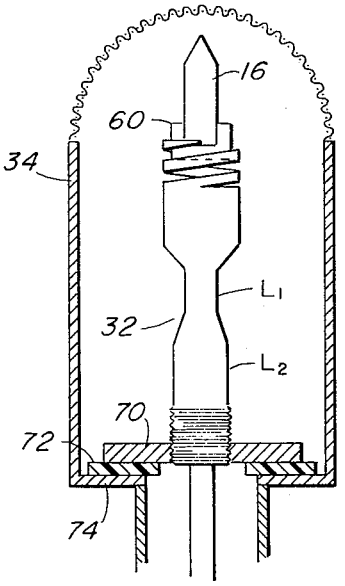
FIG. 6 is another alternative embodiment of a fixture with field shaping and impedance matching capability.

In another feature of the present invention, the termination fixture includes a device for matching the impedance of the lamp during excitation to the output impedance of the source 11. The coil 50, or the cylindrical helix in FIGS. 3 and 2 respectively provides some impedance matching because the lamp impedance is complex with the reactive part being capacitive and the coil adds a series inductive reactive impedance. However, for complete impedance matching, separate and distinct impedance matching means are preferred as shown in FIGS. 5 and 6. In FIG. 5, the field shaping device is the lamp receiving or cup shaped member 60, also shown in FIG. 11, at the first end of the inner conductor 32, this member being cupped shaped and effective to isolate the arc from the envelope. The inner conductor 32 has a first section L1 extending from the lamp receiving member 60 to a junction 62. The inner conductor 32 in the first section L1 has dimensions in length and cross section selected to transform the complex impedance of the lamp during excitation to an imput impedance to the junction 62 whose major component is the real impedance part. The inner conductor 32 has a second section L2 extending from the second end of the inner conductor to the junction 62. The inner conductor in the second section L2 has dimensions in length and in cross section effective to match the junction input impedance to the output impedance to the source 11. As shown in FIG. 5, preferably the cross section of the inner conductor in the first section L1 is smaller than the cross section in the second section L2.

The three diameter inner conductor is designed as follows. The field shaping member provides a good field pattern in the cup region (i.e., one that forms a good arc, as well as being part of the impedance matching scheme). The first section ($L_1$) transforms the impedance over a high characteristic impedance section. The second section (L2) completes the matching and can be used as a support means for a tunable capacitor sometimes needed to complete the impedance matching such as shown in FIG. 6. In the design, a suitable diameter for the field shaping section is one that gives a good field pattern for the lamp. Preferably, this diameter is about two thirds for lamp diameter for a spherical lamp, and about three halves the lamp diameter for a cylindrical lamp. The length of the field shaping section can be chosen arbitrarily, but about one twenty-fifth of a wavelength will prove to be effective. The input impedance at the junction of the field shaping and first section junction 70 can be determined if the lamp impedance for the given cup shaped member is known, by the following input impedance formula:

$$Z_1 = Z_{c_1} \frac{R + jX + Z_{c1} \operatorname{Tan} \beta l_1}{Z_{c_1} + (R + jX) \operatorname{Tan} \beta l_1} \quad (1)$$

$$= R_1 + jX_1$$

Where $R$ = the arc resistance of the lamp during excitation $X$ = the reactive impedance of the lamp during operation held at the end of the inner conductor $\beta = (2\pi)/\lambda$ $l_1$ = the length of the section $L_1$ $\lambda$ = the wavelength for the high frequency power which is applied $Z_{c_1}$ = the characteristic impedance for the first section For given R and X a length and characteristic impedance is chosen which reduces the reactive impedance ($X_1$) as given by (1) to a value substantially lower than X. Determination of R and X is obtained by several known measuring techniques, such as by noting position and magnitude of voltage standing waves along a power coupling line of known characteristic impedance or by using a network analyzer. Then for this value of $Z_1$, a length ($L_2$) and a characteristic impedance $Z_{c_2}$ for the second section L2 is determined by the following equation:

$$Z_{c_2} = \left( Z_s R_1 + \frac{Z_s X_1^2}{R_1 - Z_s} \right)^{1/2}$$

$$l_2 = \frac{\lambda}{2\pi} \tan^{-1} \frac{Z_{c2} (Z_s - R_1)}{Z_s X_1}$$

Where $Z_s$ = the impedance of the source $Z_{c_2}$ = the characteristic impedance of the second section $l_2$ = the length of the section $L_2$ The characteristic impedance is defined in terms of the dimensions of the section in terms of its cross section. In the preferred embodiments, the conductors are circular in cross section and disposed concentrically with respect to each other. For such a case, $Z_{c_1}$ or $Z_{c_2}$ is determined by the following expression.

$$\frac{138}{(\epsilon_r/\mu_r)^{1/2}} \log \frac{b}{a}$$

Where $\epsilon_r$ = dielectric constant of the medium between the conductors $\mu_r$ = permeability of the medium between the conductors $b$ = inner diameter of the outer conductor $a$ = diameter of the inner conductor For the embodiment of FIG. 5, the first section was chosen to have a length of about one twelfth wavelength. The second section, which has an impedance usually greater than that of the first section, is used to transform the impedance to a value of the source output impedance or an impedance such that a parallel capacitor can be used to attain an input impedance which is matched to that of the source. If after working the design out, the input impedance is found to be too high, it can be reduced by reducing the characteristic impedance of the first section, and if the input impedance is too low, it can be increased by increasing the impedance of the first section, keeping all other variables fixed. The sections are preferably connected by short tapers in order to reduce discontinuity capacitance.

Referring now to FIG. 6, there is illustrated a particularly preferred embodiment combining all of the features above-described. The field shaping member comprises a helical hollow center conductor previously described in reference to FIG. 3 and a cup-shaped member within the conductor. In addition, the second end of the inner conductor includes a capacitor connected across the inner and outer conductors. This capacitor comprises plates 70 which may be adjusted in position along the inner conductor by means of a threaded arrangement and a dielectric material 72 disposed between plate 70 and an end member 74 of the outer conductor 34.

The following relates to the specification of the embodiment of FIG. 6.

---

Lamp envelope cylindrical quartz 8 mm OD, 17 mm long
inner wall thickness 1 mm fill material

| | |
|---|---|
| $H_g$ | 0.2 $\mu$l |
| $ScI_3$ | 0.36 mg |
| NaI | 0.39 mg |
| $A_r$ | 20 torr |

The base of the lamp is coated with zirconium oxide to reduce heat loss. This is important in obtaining high efficiencies.

Termination Fixture

| | |
|---|---|
| helix | 2 turns<br>1.8 cm long<br>1.3 cm OD |
| $L_1$ section | 75 cm long<br>.5 cm OD |
| $L_2$ section | 2.15 cm long<br>.7 cm OD |
| cup | boron nitride as a thermal insulator |

conductors made of brass

| | |
|---|---|
| Capacitor | about 5 pf capacitance<br>2.2 cm diameter brass<br>washer, 0.001" Kapton<br>dielectric disc. |

Glass dome with conducting metal screen

Performance at 915 MHz, this lamp had an estimated efficacy of 70 lpw at 40 watts (microwave power) and 111 lpw at 60 watts. This latter light output is the same as would be obtained from a 350 watt incandescent lamp.

---

The embodiments of the present invention are intended to be merely exemplary and those skilled in the art shall be able to make numerous variations and modifications to them without departing from the spirit of the present invention. All such variations and modifications are intended to be within the scope of the present invention as defined in the appended claims.

We claim:

1. A light source including, a. a source of power at a high frequency, b. an electrodeless lamp having an envelope made of a light transmitting substance and a volatile fill material enclosed within the envelope, the fill material emitting light upon breakdown and excitation;

c. a termination fixture having an inner conductor and an outer conductor disposed around the inner conductor, the conductors having a first end which couples power to the lamp and a second end which is coupled to the source; and d. means operatively associated with the fixture for shaping the arc within the lamp during excitation so that the arc does not attach to the interior wall of the envelope thereby enhancing the life of the electrodeless lamp.

2. The light source according to claim 1, wherein the arc shaping means includes means in the region of the first end for controlling the magnitude of the power gained electrically in the region adjacent to the interior wall of the lamp envelope such that the power gained electrically in that region is not greater than the power in that region lost as heat.

3. The light source according to claim 2, wherein the power has a frequency ranging from 902 MHz to 928 MHz and wherein the conductors are circular in cross section and disposed concentrically with respect to each other.

4. A method of producing light including the steps of:

a. placing an electrodeless lamp at the ends of a pair of conductors comprising an inner conductor and an outer conductor disposed around the inner conductor, the lamp having an envelope made of a light transmitting substance and a volatile fill material enclosed within the envelope, the fill material emitting light upon breakdown and excitation;

b. applying power at a high frequency to the other ends of the conductors to excite the fill material thereby producing an arc within the envelope and c. shaping the arc within the envelope so that the arc does not attach to the envelope, thereby enhancing the life of the electrodeless lamp.

5. The method according to claim 4, wherein the step of shaping the arc includes controlling the magnitude of the difference between the power gained electrically $P_e$ and the power lost as heat $P_h$ in a region near the envelope such that $P_h$ is equal to or greater than $P_e$.

6. The method according to claim 5, wherein the step of controlling the power difference includes the step of limiting the magnitude of the electric field strength in said region thereby reducing the power gained electrically in the region.

7. The method according to claim 6, wherein the step of limiting the field strength includes the step of shaping the geometry of the end of the inner conductor which is in contact with the lamp.

* * * * *

UNITED STATES PATENT OFFICE

CERTIFICATE OF CORRECTION

Patent No. 3,942,058 Dated March 2, 1976

Inventor(s) P. Haugsjaa/W. Nelson/R.Regan/W. McNeill

It is certified that error appears in the above-identified patent and that said Letters Patent are hereby corrected as shown below:

Column 1, line 33, delete "Fehsenfield" and insert --Fehsenfeld--;
Column 1, line 42, delete "(inaped-" and insert --(imped- --;
Column 3, line 46, delete "trode-less" and insert --trodeless--;
Column 5, line 60, delete "torodial" and insert --toroidal--;
Column 6, line 10, delete "torodial" and insert --toroidal--;
Column 6, line 51, delete "imput" and insert --input--;

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*